US009063442B2

(12) United States Patent
Nakamura et al.

(10) Patent No.: US 9,063,442 B2
(45) Date of Patent: Jun. 23, 2015

(54) DEVELOPING DEVICE WITH DEVELOPER REPLENISHMENT

(71) Applicant: Konica Minolta, Inc., Tokyo (JP)

(72) Inventors: Kosuke Nakamura, Hachioji (JP); Hiroyuki Kozuru, Otsuki (JP); Yoshiyasu Matsumoto, Fuchu (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/155,614

(22) Filed: Jan. 15, 2014

(65) Prior Publication Data

US 2014/0205327 A1 Jul. 24, 2014

(30) Foreign Application Priority Data

Jan. 18, 2013 (JP) ..... 2013-006863

(51) Int. Cl.
*G03G 15/08* (2006.01)
*G03G 9/083* (2006.01)

(52) U.S. Cl.
CPC ..... *G03G 9/0832* (2013.01); *G03G 9/0833* (2013.01); *G03G 15/0879* (2013.01); *G03G 2215/0607* (2013.01)

(58) Field of Classification Search
CPC ..... G03G 9/0832; G03G 9/0833; G03G 15/0865; G03G 15/0879; G03G 2215/0607
USPC ..... 399/29, 258, 259
See application file for complete search history.

(56) References Cited

U.S. PATENT DOCUMENTS

2009/0123856 A1* 5/2009 Hotta et al.
2010/0055601 A1* 3/2010 Sugiura et al.

FOREIGN PATENT DOCUMENTS

JP 59-010071 1/1984
JP 2007-079578 3/2007
JP 2007133100 A * 5/2007
JP 2009-205149 9/2009

OTHER PUBLICATIONS

Spar, Steven, Partial Translation of para.0089 of JP 2007-133100, provided to applicants as a courtesy to aid in clear prosecution.*

* cited by examiner

*Primary Examiner* — David Gray
*Assistant Examiner* — Laura Roth
(74) *Attorney, Agent, or Firm* — Lucas & Mercanti, LLP

(57) ABSTRACT

A developing device includes a developer container, a developing unit, a developer outlet and a replenishment developer inlet. The developer container contains a developer composed of a toner and a first carrier. The developing unit develops an electrostatic latent image on an image carrier using the developer. The developer outlet discharges the developer. The replenishment developer inlet supplies a replenishment developer to the developer container. The replenishment developer includes a second carrier. A ratio of a poured bulk density of the second carrier to a poured bulk density of the first carrier ranges from 0.60 to 0.95.

9 Claims, 7 Drawing Sheets

DEVELOPING DEVICE WITH DEVELOPER REPLENISHMENT

BACKGROUND OF THE INVENTION

1. Field of the Invention

The present invention relates to a developing device and an image forming apparatus, and more specifically relates to an electrophotographic developing device that maintains a stable electrical charge for long-term use and stably provides high-quality images with high density and no fogging, and an electrophotographic image forming apparatus including the electrophotographic developing device.

2. Description of Related Art

In a typical electrophotographic image forming apparatus used in offices, a two-component developer is usually used. A two-component developer is used in a developing device in such a way that a toner and a carrier are agitated and mixed to electrically charge the toner and the charged toner is then provided on the surface of a photoreceptor to visualize (develop) an electrostatic latent image. Thus, only the toner is consumed in a repeated development of electrostatic latent images. The carrier is not consumed and remains in the developing device for a repeated use. In such a conventional method for development, only the consumed toner is replenished into a developing device.

A repeated image formation causes adhesion of toner particles, additives of the toner, and/or components of the toner matrix, which are generated because of mechanical stress in a developing device, on the surfaces of the carrier particles (this phenomenon is known as a "spent toner problem"). This lowers the electrical chargeability of the carrier, i.e., lowers the ability to electrically charge the toner. Thus, a repeated image formation impedes appropriate electrical charging of the toner, causing fogging and low image density of the images, which requires replacement of the developer after the formation of a certain number of images.

The development characteristics of a developer significantly differ between immediately before and after the replacement. Thus, the characteristics of the images also differ largely. Given this, Japanese Patent Application Laid-Open Publications Nos. Sho59-10071 and 2007-079578 each propose a developing device that achieves stable image quality through the prevention of degradation of the developer, the extension of the developer life, and the control of the development characteristics of the developer within certain ranges. In detail, the developing device maintains the charging characteristics of a developer in a developing device over an extended period through a repeated disposal of a small amount of degraded developer having lowered electrical chargeability and a repeated replenishment of a fresh developer, stabilizes the image characteristics, extends the developer life, and lowers the replacement frequency of the developer. Such a development system is known as an auto-refining development system or a trickle development system.

In such a system, a small amount of degraded developer is repeatedly discarded parallel to a repeated formation of images while a fresh developer having high electrical chargeability is repeatedly replenished. In this way, stable electrical chargeability of a developer in a developing device can be maintained for an extended period. As a result, high-quality images with high density and no fogging can be stably produced over an extended period.

A developer containing a carrier having a large specific weight provides a quick rise of electrical charge, in other words, provides required electrical charge at the initial rise or immediately after it is replenished, because it has high agitation intensity in a developing device. However, such a carrier inflicts a large amount of stress on a toner, accelerating the degradation of the carrier due to the spent toner problem.

A decrease in the chargeability due to the degradation of a carrier causes a decrease in the electrical charge of a toner. This causes a decrease in an image quality due to fogging. This may also cause a decrease in the transfer rate from the photoreceptor to a transfer medium and/or adhesion of the carrier.

The decrease in the image quality and transfer rate and the adhesion of the carrier due to the degradation of the carrier can be prevented through an increase in the amount of the carrier supplied, i.e., an increase in the replacement rate. If the amount of the carrier supplied is reduced, the image quality will decrease largely due to accelerated degradation of the carrier.

The copying of a document having a large black area consumes a large amount of toner. If a developer that is a mixture of a toner and a carrier is supplied in copying such a document, the large amount of the toner must be replenished (supplied) together with a large amount of the carrier. As a result, a large amount of the developer is wasted.

Although an auto-refining development system is employed to extend the developer life and stabilize the image quality, the use of a developer containing a carrier having a large specific weight cannot sufficiently achieve these advantages over an extended period because a large amount of the developer is wasted.

On the other hand, Japanese Patent Application Laid-Open Publication No. 2009-205149 discloses a technology that can be applied to a developing device requiring replenishment of the developer. In this technology, a porous magnetic carrier having a small specific weight is used for a carrier contained in a developer in the developing device and is used for a carrier for replenishment. The toner in a developer not used for a long time has a decreased electrical charge. Thus, a porous carrier having a small specific weight cannot sufficiently charge such a lowly charged toner within a short time. This causes drawbacks such as fogging and toner scattering.

SUMMARY OF THE INVENTION

An object of the present invention, which has been conceived in light of the problems and circumstances described above, is to provide a developing device and an image forming apparatus that prevent the degradation of a carrier to stabilize the electrical charge characteristics of a developer, establish a high transfer rate, prevent carrier adhesion, and stably provide high-quality images with no fogging over an extended period.

According to a first aspect of the present invention, there is provided a developing device including:

a developer container which contains a developer composed of a toner(s) and a first carrier;

a developing unit which develops an electrostatic latent image on an image carrier using the developer contained in the developer container;

a developer outlet which discharges the developer contained in the developer container; and a replenishment developer inlet which supplies a replenishment developer to the developer container, wherein the replenishment developer includes a second carrier, and a ratio of a poured bulk density of the second carrier to a poured bulk density of the first carrier ranges from 0.60 to 0.95.

According to a second aspect of the present invention, there is provided an image forming apparatus including the above developing device(s).

BRIEF DESCRIPTION OF THE DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
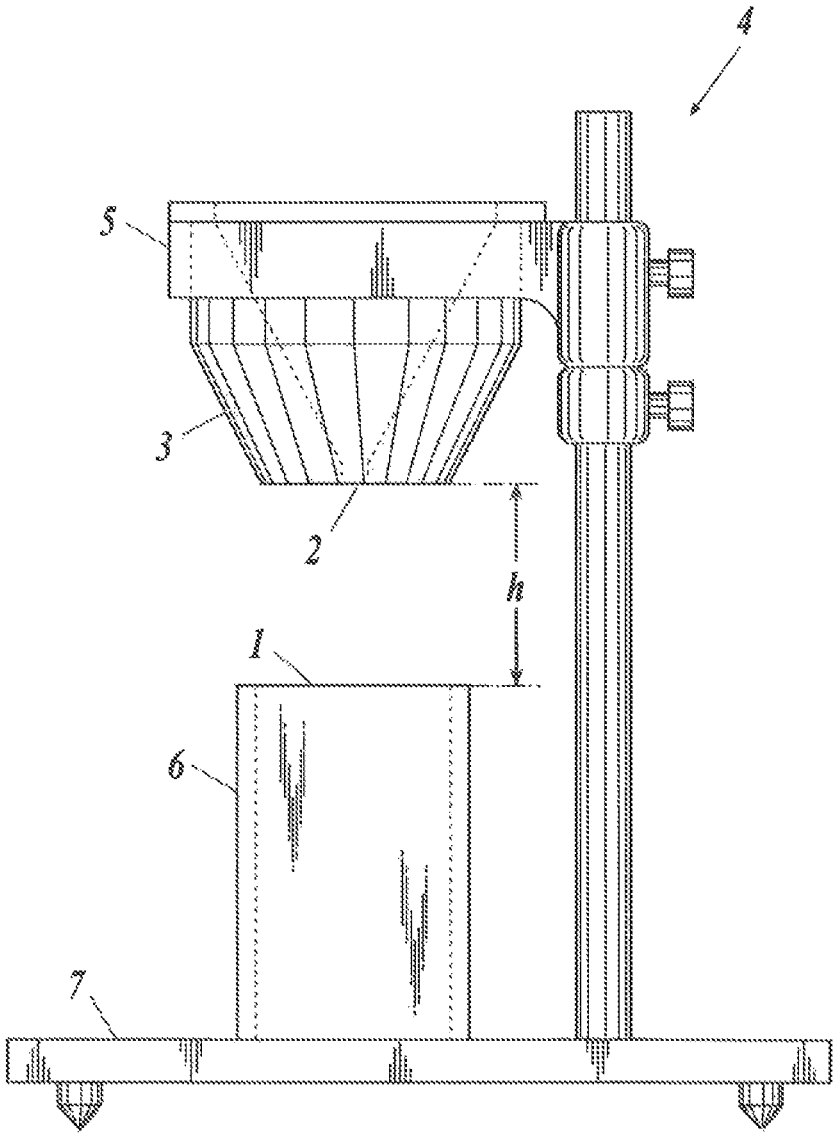
FIG. 1 is a diagram for describing a method for measuring a poured bulk density of a carrier of the present invention.

A developing device of the present invention includes: a developer container which contains a developer composed of a toner(s) and a first carrier; a developing unit which develops an electrostatic latent image on an image carrier using the developer contained in the developer container; a developer outlet which discharges the developer contained in the developer container; and a replenishment developer inlet which supplies a replenishment developer to the developer container, wherein the replenishment developer includes a second carrier, and a ratio of a poured bulk density of the second carrier to a poured bulk density of the first carrier ranges from 0.60 to 0.95.

These are technological characteristics common to the aspects and preferred embodiments of the present invention.

In an embodiment of the present invention, the difference between the poured bulk density of the second carrier and the poured bulk density of the first carrier is preferably greater than 0.2 g/cm$^3$. Such a difference prevents degradation in the chargeability of the carrier.

In another embodiment of the present invention, the first carrier and the second carrier preferably contain resin-coated carrier particles composed of carrier core particles covered with resin. Such carriers can control the electrical resistivity and the charge of the carrier within preferred ranges.

In another embodiment of the present invention, the ratio of a magnetization at 1000 Oe per bulk volume of the second carrier to a magnetization at 1000 Oe per bulk volume of the first carrier ranges preferably from 0.84 to 1.15. Such a ratio achieves a constant amount of toner delivery to the development sleeve.

In another embodiment of the present invention, the remanence magnetization of the second carrier ranges preferably from 0.1 to 5.0 A·m$^2$/kg. Such remanence magnetization achieves satisfactory fluidity of the carrier.

In another embodiment of the present invention, the average roundness of toner particles constituting the toner ranges preferably from 0.900 to 0.970. Such average roundness raises the fluidity of the toner and acquires high-density image. The toner particles having such average roundness are resistive to damage caused by stress and the spent toner problem.

In another embodiment of the present invention, carrier core particles constituting at least the second carrier are preferably porous ferrite particles of a ferrite represented by a following formula:

$$(MO)_x(Fe_2O_3)_y,$$

wherein M represents a metal atom selected from the group consisting of manganese, magnesium, strontium, calcium, titanium, copper, zinc, nickel and silicon or a combination thereof, x represents a molar ratio of 5 to 70 mol %, and y represents a molar ratio of 30 to 95 mol %. Such core particles achieve desirable magnetization properties.

In another embodiment of the present invention, carrier core particles constituting at least the second carrier are preferably porous ferrite particles having pores with diameters ranging from 0.2 to 0.7 μm. Such core particles having pores with the above diameters achieve the poured bulk density within a desirable range.

The developing device of the present invention is suitably installed in an image forming apparatus.

The present invention therefore provide a developing device and an image forming apparatus that prevent the degradation of a carrier to stabilize the electrical charge characteristics of a developer, establish a high transfer rate, prevent carrier adhesion and stably provide high-quality images with no fogging over an extended period.

The mechanisms that establish the advantages of the present invention are not definitely clear, but the following inference has been made.

A carrier having a large bulk density or large specific weight has high agitation intensity in the developing device. Thus, the initial electrical charge of the toner rises quickly, and toner particles having a low electrical charge are also immediately charged to a desired level. Developers often have a low electrical charge after being unused for a long time before being packed in developing devices, such as copiers and printers, after being unused for a long time after being packed in developing devices, or after being unused under a humid environment. In a developer containing a carrier having a large specific weight, the toner is sufficiently charged by friction within a short time because mixing causes high energy collision of the carrier with the toner, and instantaneously recharges the toner to a desired level.

The large specific weight of the carrier causes high agitation (mixing) stress to be inflicted on the developing device and severe degradation due to the spent toner problem. Thus, if the rate of replacement of the developer is low in the developing device, the electrical chargeability of the developer gradually decreases. The lowering of the electrical chargeability causes low image quality due to fogging, a low transfer rate, and/or carrier adhesion.

The replenishment of a porous carrier that has a small bulk density or small specific weight lowers the agitation stress. Thus, stable chargeability is maintained without a significant decrease for a long time, enabling the formation of high-quality images.

That is, the ratio of the poured bulk density of the carrier for replenishment to the carrier contained in the developing device is set within the range of 0.60 to 0.95 to reduce stress in the developing device. In this way, lowering of the chargeability of the carrier can be prevented even if the replacement rate of the carrier is low. Such a control stabilizes the charge characteristics of the developer, increases a transfer rate, prevents carrier adhesion, and thus stably provides high-quality images with no fogging over an extended period.

The components of the present invention and the embodiments of the present invention will now be described in detail.

Throughout the specification, the description of "the upper limit to the lower limit" denoting the numerical range denotes "not less than the lower limit but not more than the upper limit".

<<Overview of Developing Device of Present Invention>>

An auto-refining developing device of the present invention includes a developer container that contains a developer composed of a toner(s) and a first carrier; a developing unit that develops an electrostatic latent image on an image carrier (which is also referred to as "photoreceptor") using the developer contained in the developer container; a developer outlet which discharges the developer contained in the developer container; and a replenishment developer inlet which supplies a replenishment developer to the developer container, wherein the replenishment developer includes a second carrier, and a ratio of a poured bulk density of the second carrier to a poured bulk density of the first carrier ranges from 0.60 to 0.95.

In an auto-refining development system, a toner and a carrier are supplied together or independently to a developing device and the degraded developer is discharged during a repeated image formation. An auto-refining development system therefore can stabilize the development characteristics of the developer over an extended period, and thus stably provide high-quality images over an extended period.

The developer contained in the developer container in the developing device of the present invention contains at least two types of carriers having different poured bulk densities, e.g., a porous carrier and a non-porous carrier. The replenishment developer contains a porous carrier. The porous carrier contained in the developer contained in the developer container may be the same as or different from the porous carrier in the replenishment developer. In case where the porous carrier contained in the replenishment developer is the same as the porous carrier contained in the developer contained in the developer container, the replenishment of the developer containing the porous carrier to the developer contained in the developer container adds the porous carrier in the replenishment developer to the developer contained in the developer container, and the developer contained in the developer container thus contains at least two types of carriers having different poured bulk densities, e.g., contains at least the added porous carrier and the non-porous carrier particles.

The components of the present invention will now be described one by one in detail. The developing device and the image forming apparatus of the present invention will be described later in detail.

<<Developer>>

The developer of the present invention is a two-component developer containing a toner(s) and a carrier(s).

The carrier of the two-component developer of the present invention preferably contains resin-coated carrier particles composed of carrier core particles covered with resin. The resin coating leads to ready regulation of the electrical resistivity of the carrier particles and stabilizes the chargeability.

<<Carrier>>

<Carrier Core Particle>

The carrier core particles constituting the porous carrier and non-porous carrier in the developer contained in the developer container and the porous carrier in the replenishment developer are composed of, for example, metal particles such as iron particles or various ferrite particles, or particles in which such particles are dispersed in resin. Among them, the ferrite particles are most preferred.

Preferable ferrites are ferrites containing heavy metals such as copper, zinc, nickel or manganese, and light metal ferrites containing an alkali metal(s) and/or an alkaline earth metal(s). Specifically, the ferrites represented by General Formula 1 are preferred.

$$(MO)_x(Fe_2O_3)_y \qquad \text{General Formula 1:}$$

In the formula, x and y each represent a molar ratio.

In General Formula 1, M represents one or a combination of the following metal atoms other than iron (Fe):manganese (Mn), magnesium (Mg), strontium (Sr), calcium (Ca), titanium (Ti), copper (Cu), zinc (Zn), nickel (Ni), aluminum (Al), silicon (Si), zirconium (Zr), bismuth (Bi), cobalt (Co), and lithium (Li). Among them, manganese (Mn), magnesium (Mg), strontium (Sr), calcium (Ca), titanium (Ti), copper (Cu), zinc (Zn), nickel (Ni) and silicon (Si) are preferred.

The ferrite represented by General Formula 1 preferably has a molar ratio y of $Fe_2O_3$ within the range of 30 to 95 mol %. Ferrite particles having a molar ratio y in this range readily acquire desired magnetic characteristics and thus are suitable for a carrier having high conveyance.

(Porous Ferrite)

The porous carrier contained in the developer and the replenishment developer of the present invention preferably contains porous ferrite particles. A porous ferrite particle is composed of a chemical compound represented by General Formula 1 and has fine pores with submicron-diameters. The fine pores are openings that bores into the particle from the surface of a ferrite particle. The fine pores may be openings that do not pass through the particle. Such fine pores form voids in the ferrite particles and thus the specific weight or bulk density of the carrier can be controlled. The poured bulk density of a non-porous ferrite carrier composed of non-porous ferrite particles not having fine pores is usually within the range of approximately 2.1 to 2.8 g/cm$^3$. The formation of fine pores decreases the poured bulk density. The poured bulk density of the carrier in the developer contained in the developer container and that of the carrier in the replenishment developer can be controlled by the fine pores in the ferrite particles.

The porous carrier of the present invention preferably contains porous ferrite particles with fine pores having diameters within the range of 0.2 to 0.7 μm.

(Non-Porous Ferrite)

The non-porous carrier in the developer of the present invention preferably is composed of non-porous ferrite particles. The non-porous ferrite particles in the non-porous carrier differ from the porous ferrite particles mentioned above in that they have no fine pores. The non-porous carrier therefore have a poured bulk density of greater than 2.1 g/cm$^3$.

(Measurement of Diameter of Fine Pore)

In the present invention, the diameter of the fine pores in the porous ferrite particles indicates the average diameter of the fine pores measured through a mercury intrusion porosimetry. The specific measurement process of the diameter of the fine pores of the porous ferrite particles will now be described.

The porosity of a sample (2 $cm^3$ of porous ferrite particles) is measured with mercury porosimeters Pascal 140 and Pascal 240 manufactured by Thermo Fisher Scientific Inc. The sample is encapsulated in a commercially available gelatinous capsule having multiple holes. The capsule is then placed in a dilatometer (CD3P for powder). After the dilatometer is degassed and filled with mercury, the intrusion volume of the mercury under low pressure (within the range of 0 to 400 kPa) is measured as a "first run" with the porosimeter Pascal 140. After re-degassing, the intrusion volume of the mercury under low pressure (within the range of 0 to 400 kPa) is measured as a "second run". After the "second run", the sum of the masses of the dilatometer, the mercury, the capsule, and the sample are measured.

Subsequently, the porosimeter Pascal 240 is used to measure the intrusion volume of the mercury under high pressure (within the range of 0.1 to 200 MPa). The volumes and diameters of the fine pores of the porous ferrite particles and the distribution of the diameters of the fine pores are determined on the basis of the intrusion volume of the mercury measured under high pressure. The diameter of a fine pore is calculated on the basis of a surface tension of mercury of 4.80 mN/cm and a contact angle of 141.3°.

<Method for Producing Ferrite Particle>

The porous ferrite particles used for the replenishment developer of the present invention are produced as described below. An appropriate amount of a raw material(s) are weighed and then the raw material(s) are pulverized and mixed in a mill such as a ball mill or a vibrating mill, for at least 0.5 hour or, and preferably within the range of 1 to 20 hours. The resulting pulverized product is pelletized using a pressure molding machine. The pellets are then calcined at a temperature within the range of 700° C. to 1200° C.

Alternatively, water may be added to the pulverized product to form a slurry, followed by granulation of the slurry using a spray drier, without the use of a pressure molding machine. After the calcination, the pellets are pulverized again in a mill such as a ball mill or a vibrating mill. The viscosity of the pulverized product is adjusted by adding water and, if necessary, a dispersant and/or a binder. The resulting pulverized product is then granulated and is sintered at a temperature within the range of 1000° C. to 1500° C. for 1 to 24 hours under a controlled oxygen level. The pulverization after the calcination may be performed by adding water and using a wet ball mill or a wet vibration mill.

Any type of mill, such as the ball mill and vibrating mill, can be used. Use of minute beads as dispersing media having a diameter of 1 mm or less is preferred to effectively and uniformly disperse the raw material. The diameter, composition, and pulverization time of the heads can be adjusted to control the degree of pulverization.

The sintered product is pulverized and classified. A known classification method, such as air classification, mesh filtration, or precipitation, is used to adjust the grain size into a desired diameter.

If required, an oxide layer can be formed on the surfaces of the grains through low-temperature heating for adjustment of the electrical resistivity. The oxide layer is formed in a common furnace such as an electric rotary furnace or an electric batch furnace by heating the grains at 300° C. to 700° C., for example. The thickness of the oxide layer formed in such a process is preferably within the range of 0.1 nm to 5 μm. An oxide layer having such a thickness is advantageous in that desired characteristics are acquired without an excess increase in resistance. If required, a reduction operation can be performed before the formation of the oxide layer.

The poured bulk density and the true density of the ferrite can be controlled through various factors such as the composition of the raw material(s), the level of pulverization of the raw material(s), the employment of calcination, the temperature of calcination, the time of calcination, the amount of a binder(s) added for granulation by a spray drier, the moisture content, the degree of drying, the method of sintering, the temperature of sintering, the time of sintering, the method for disintegration, and the reduction by hydrogen gas. These controlling methods can be applied without limitation. An example of the control will now be described.

The ferrite particles tend to have a smaller poured bulk density if hydroxides or carbonates are selected as the raw material(s) compared with oxides. The true density and the apparent density tend to be small if oxides of Mn, Mg, Ca, Sr, Li, Ti, Al, Si, Zr, and Bi are selected as the raw material(s) compared with oxides of heavy metals such as Cu, Ni and Zn.

The poured bulk density is decreased by skipping the calcination. If calcination is performed, the poured bulk density tends to be decreased at a lower calcination temperature.

In granulation with a spray drier, a lower poured bulk density is achieved by addition of a larger amount of water to form slurry from the raw material(s) and by sintering at a lower temperature.

To achieve a desired poured bulk density, one or more of these controlling methods may be used alone or in combination.

Similarly, the non-porous ferrite particles can be produced by appropriately combining the conditions described above.

<Resin-Coated Carrier Particle>

The carrier particles of the present invention may be bare ferrite particles, more preferably resin-coated carrier particles composed of ferrite core particles coated with resin. The resin coating layers of the resin-coated carrier particles control the electrical resistivity and chargeability of the carrier particles and also increase the durability of the carrier particles.

The carrier particles of the present invention preferably have a volume-based median diameter ($D_{50}$) within the range of 15 to 80 μm, and more preferably 20 to 60 μm. Carrier particles having such a volume-based median diameter stably form high-quality toner images. The volume-based median diameters of the carrier core particles and the carrier particles can be measured with a laser-diffraction grain-size distribution measuring device HELOS (manufactured by Sympatec GmbH) equipped with a wet dispersion unit.

The average thickness of the resin coating layer is preferably within the range of 0.05 to 4.0 μm, and more preferably 0.2 to 3.0 μm to establish durability and low electrical resistivity of the carrier.

The carrier of the present invention preferably has an electrical resistance within the range of $10^7$ to $10^{12}$ Ω·cm, and more preferably $10^8$ to $10^{11}$ Ω·cm. A carrier having such an electrical resistance is optimal for the formation of high-density toner images.

(Resin for Coating)

The carrier particles of the present invention are preferably resin-coated carrier particles composed of core particles coated with resin. Examples of the resin used for coating include polyolefin resins, such as polyethylene, polypropylene, chlorinated polyethylene, and chlorosulfonated polyethylene; polystyrene resins; acrylic resins, such as polymethyl methacrylate; polyvinyl and polyvinylidene resins, such as polyacrylonitrile, polyvinyl acetate, polyvinyl alcohol, polyvinyl butyral, polyvinyl chloride, polyvinyl carbazole, polyvinyl ether, and polyvinyl ketone; copolymer resins, such as vinyl chloride-vinyl acetate copolymers and styrene-acrylic acid copolymers; organosiloxane-bonded silicone resins and their modified resins (for example, alkyd resins, polyester resins, epoxy resins, and other polyurethane-based modified resins); fluororesins, such as polytetrachloroethylene, polyvinyl fluoride, polyvinylidene fluoride and polychlorotrifluoroethylene; polyamide resins; polyester resins; polyurethane resins; polycarbonate resins; amino resins such as urea-formaldehyde resin; and epoxy resins.

Among these resins, acrylic resins are preferred for the ready formation of a resin coating through satisfactory adhesion to the core particles and through fixation by mechanical shock and heat.

Examples of the acrylic resins include polymers of acyclic methacrylic ester monomers such as methyl methacrylate, ethyl methacrylate, propyl methacrylate, n-butyl methacrylate, hexyl methacrylate, octyl methacrylate and 2-ethylhexyl methacrylate; and polymers of alicyclic methacrylic ester monomers having a cycloalkyl ring of 3 to 7 carbon atoms, such as cyclopropyl methacrylate, cyclobutyl methacrylate, cyclopentyl methacrylate, cyclohexyl methacrylate and cycloheptyl methacrylate.

Preferred acrylic resins for abrasion resistance and electrical resistance are copolymers of alicyclic methacrylic ester monomers and acyclic methacrylic ester monomers.

The mass percentage of the acyclic methacrylic ester monomers to the total mass of the monomers is preferably within the range of 10 to 70 mass %. A copolymer of the above acrylic resin(s) with a styrene monomer such as styrene, α-methylstyrene or para-chlorostyrene may also be selected.

(Production of Resin-Coated Carrier Particle)

A preferred method for coating the carrier core particles with resin is dry coating. Dry coating may be performed, for example, with a hybridizer equipped with a rotor and a liner (manufactured by Nara Machinery Co., Ltd.), or more preferably a high-speed agitation mixer illustrated in FIG. 2.

Figure 2:
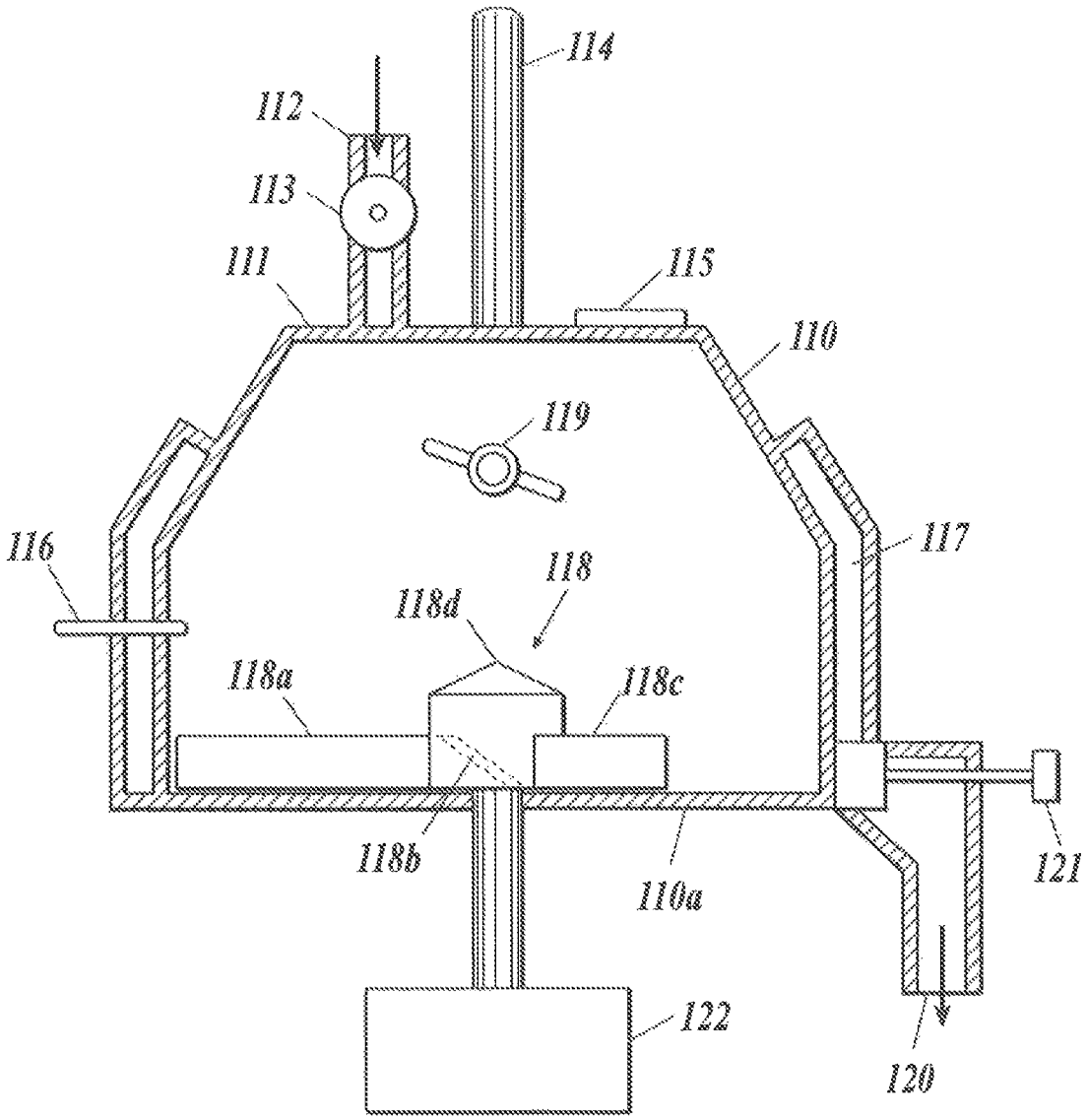
FIG. 2 is a schematic diagram illustrating a device for producing resin-coated carrier particles of the present invention.

In FIG. 2, 111 denote an upper cover. On or in the upper cover 111, a raw-material inlet 112, an inlet valve 113, a filter 114, an inspection window 115 and a temperature sensor 116 are provided.

Predetermined amounts of carrier core particles and resin particles are fed through the raw-material inlet 112. These fed raw materials are mixed using a horizontal rotor 118 driven by a motor 122. The horizontal rotor 118 has mixing blades 118*a*, 118*b* and 118*c* that are radially attached to a center part 188*d* at an angle of 120° to each other. The blades are attached at a 35° angle from the bottom part 110*a*. The high-speed rotation of the mixing blades 118*a*, 118*b* and 118*c* mix and blow up the raw materials. Such raw materials collide with the upper inner wall of the container 110 and then fall. The falling raw materials collide with a vertical rotor 119. The high-speed agitation mixer, which mixes the raw materials as described above, involves the following steps (a) to (d) to prevent damage of the carrier core particles due to collision with each other and to form a coating layer that is uniform and highly adhesive. Preferable conditions for each step will be described below.

(a) Preliminary mixing: Water cooled to 10° C. to 15° C. is circulated through a jacket 117; the mixing blades 118*a*, 118*b*, and 118*c* rotate at a peripheral speed of 1 m/s or less; the internal temperature of the container 110 is set to a temperature lower than the glass-transition temperature (Tg) of the resin particles, normally set to 50° C. or less; and the raw materials are mixed for 1 to 2 minutes.

(b) Formation of intermediate: The fed raw materials are mixed again for 10 to 20 minutes under the same conditions.

(c) Formation of film: The mixing blades rotate at a peripheral speed equal to or greater than that in step (b); the container is heated to the glass-transition temperature Tg of the resin particles or higher by circulating warm water through the jacket 117; and the raw materials are mixed.

(d) Post-film formation process: The container is cooled by circulating water that is cooled to 10° C. to 15° C. through a jacket 117. The mixing blades rotate for mixing and cooling at a peripheral speed equal to or smaller than that in step (c). When the internal temperature of the container falls to or below the glass-transition temperature Tg of the resin particles or normally 70° C., a discharge valve 121 is opened to discharge obtained carrier particles through the outlet 120.

(Average Thickness of Resin Coating Layer)

The average thickness of the resin coating layer is determined as described below.

A focused ion beam apparatus SMI2050 (manufactured by SII NanoTechnology Inc.) is operated to produce slices of the carrier particles. A cross-sectional, surface of each slice is examined microscopically at a magnification of 5000× with a transmission electron microscope JEM-2010F (manufactured by JEOL, Ltd.) The average of the maximum thicknesses and the minimum thicknesses of the particles measured within each visual field is defined as the average thickness of the resin coating layer.

(Magnetization of Carrier)

The carrier of the present invention has a preferred saturation magnetization within the range of 30 to 80 $A \cdot m^2/kg$ and a remanence magnetization within the range of 0.1 to 5.0 $A \cdot m^2/kg$. A carrier having such magnetic characteristics prevents the partial aggregation of the carrier, uniformly disperses a two-component developer on the surface of a developer conveyer, and forms a uniform and fine toner images without unevenness in density.

Preferred ferrite particles having a remanence magnetization within the range described above improve the fluidity of the carrier and provide a two-component developer with a uniform bulk density.

<Measurement of Poured Bulk Density and Magnetization>

(Preparation of Carrier to be Measured)

In the present invention, the developer contained in the developing device and the replenishment developer have different physical properties. Consequently, the compositions of the developer contained in the developing device vary from the developer outlet to the replenishment developer inlet. Because of this difference, the carrier of the developer in the developing device have to be sufficiently mixed before sampling to determine the physical properties of the carrier.

Specifically, the replenishment developer inlet of the developing device is closed and the developer contained in the developer container is mixed for five minutes to prepare a homogeneous carrier The developer is then sampled from the side of a development roller. The toner is then separated from the sampled developer, and the remaining carrier is measured.

(Measurement of Poured Bulk Density)

The poured bulk density (apparent density) can be determined in accordance with Japanese Industrial Standards (JIS) Z2504 as described below.

As illustrated in FIG. 1, a 25-$cm^3$ cylindrical container 6, which has a circular opening 1 with a diameter of 28 mm on its upper end, is placed on a container base 7 arranged on a horizontal plane. A funnel holder 5 of a stand 4 on the container base 7 holds a funnel 3, which has an outlet 2 with a diameter of 2.5 mm at its lower end. The funnel 3 is placed immediately above the cylindrical container 6 such that the distance h from the upper end of the container to the outlet 2 is 25 mm. A sample dried under specific conditions is poured from the outlet 2 of the funnel 3 into the container 6 through the opening 1 until the sample overflows from the opening 1.

The excessive sample is removed by horizontally leveling the sample at the opening 1 on the upper end of the container 6. The sample packed inside the container 6 is weighed. The poured bulk density d (g/cm$^3$) of the sample poured in the container is determined by applying the measured weight of the sample to Equation (1).

$$d=[\text{mass of sample in container(g)}]/[\text{volume of container (cm}^3)] \quad \text{Equation (1):}$$

(Measurement of Magnetization)

The magnetization of the ferrite particles and the carrier is determined as follows. 25 mg of a sample is measured with a high-sensitivity vibrating sample magnetometer VSM-P7-15 (manufactured by Toei Industry Co., Ltd.). The measurement magnetic field is varied stepwise from −5000/4π A/m (−5 kOe) to 5000/4π A/m (+5 kOe) to determine the magnetization $\sigma^{1000}$ (A·m$^2$/kg) under a magnetic field having an intensity of 1000/4π A/m (1000 Oe).

The remanence magnetization (A·m$^2$/kg) is obtained as a value at a magnetic field with an intensity of zero, through the above measurement of the magnetization.

The magnetization per bulk volume is determined by Equation (2).

$$\text{magnetization per bulk volume(A/m)}=\text{magnetization } \sigma^{1000}(\text{A}\cdot\text{m}^2/\text{kg})\times\text{poured bulk density } d(\text{g/cm}^3) \quad \text{Equation (2):}$$

<<Toner>>

Examples of methods for producing the toner of the present invention include kneading pulverization, suspension polymerization, emulsification aggregation, dissolution suspension, polyester extension and dispersion polymerization.

Among them, emulsification aggregation is preferred because it yields toner particles with a uniform diameter and a desired shape, which are important factors for the stable formation of high-quality images and allows ready formation of core-shell particles.

In emulsification aggregation, toner particles are produced through the following steps: a dispersion containing resin fine particles dispersed therein with a surfactant or a dispersion stabilizer are mixed with a dispersion containing toner constituents including, if needed, colorant fine particles; a flocculant is added to the mixed dispersion for aggregation to form toner particles having desired diameters; and upon or after the aggregation, the resin fine particles are fused to control the shape of the toner particles. As an option, the resin fine particles may contain an internal additive(s) such as a parting agent and a charge control agent. Alternatively, the resin fine particles may be composite particles having at least two layers of resins with different compositions.

Different types of resin fine particles may be added upon aggregation to form toner particles with a core-shell structure, which is a preferred structure.

The resin fine particles can be produced through any one of or a combination of methods such as emulsion polymerization, mini-emulsion polymerization and phase-transfer emulsification. Mini-emulsion polymerization is preferred for the inclusion of internal additives in the resin fine particles.

(Average Roundness)

The toner particles of the toner of the present invention preferably has an average roundness within the range of 0.900 to 0.970, and more preferably 0.930 to 0.965, to achieve higher transfer efficiency. The average roundness can be measured with a flow particle image analyzer FPIA-2100 (manufactured by Sysmex Corporation). Specifically, the average roundness is measured through the flowing steps: the toner is mixed with a solution containing a surfactant and then the toner particles are dispersed by the application of ultrasonic waves for one minute; the flow particle image analyzer FPIA-2100 acquires an image of the dispersed toner particles in an appropriate density such that 3000 to 10000 particles can be detected in an HPF (high magnification) mode; the roundness of the individual toner particles is calculated by Equation (3); and the sum of the roundness of the individual toner particles is divided by the total number of the toner particles to calculate the average roundness.

$$\text{roundness}=\text{perimeter determined from circle–equivalent diameter/perimeter of particle projection image} \quad \text{Equation (3):}$$

(Toner Content in Developer)

The developer of the present invention is a two-component developer which is a mixture of a carrier(s) and a toner(s). Normally, the mass percentage of the toner to the developer contained in the developing device is preferably within the range of 4 to 16 mass %. The mass percentage of the carrier to the replenishment developer of the present invention for the auto-refining development is preferably within the range of 3 to 20 mass %.

<<Developing Device>>

The developing device of the present invention will now be described.

<Configuration of Developing Device>

Figure 3:
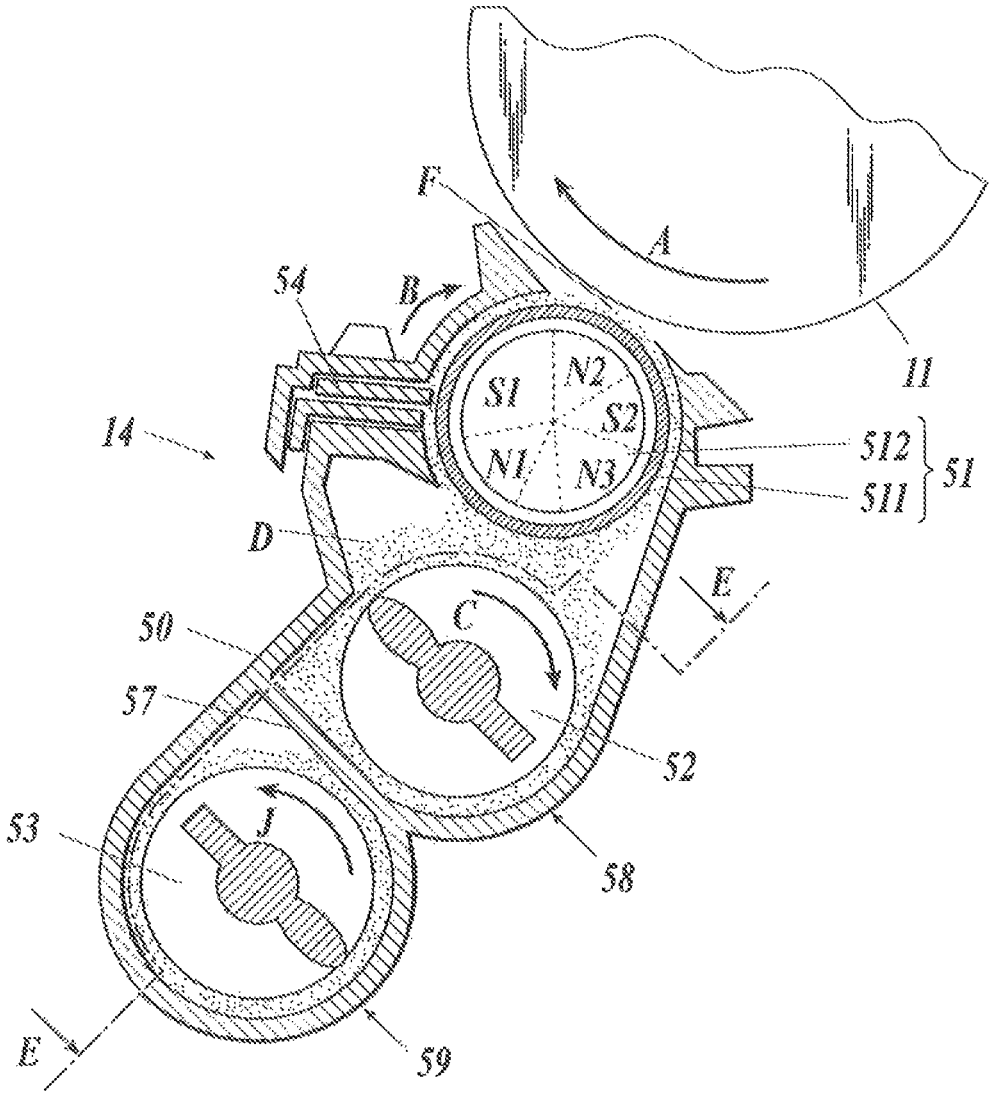
FIG. 3 is a schematic cross-sectional view illustrating an exemplary configuration of a developing device of the present invention to be installed in a printer.

FIG. 3 is a schematic cross-sectional view of an exemplary configuration of a developing device 14.

As illustrated in FIG. 3, the developing device 14 includes a housing 50 as a developer container, a development roller 51 as a developing unit, a supply screw 52, a mixing screw 53, and a regulator 54. The components 50 to 54 each extend parallel to the axial direction of the development roller 51 (which is the direction orthogonal to the drawing, hereinafter referred to as the axial direction). A full-color electrophotographic image forming apparatus includes four developing devices 14 each for the four colors of yellow (Y), magenta (M), cyan (C), or black (K). The developing device 14 for black (K) will now be described. Since the structures of the developing devices 14 for the other colors are the same, descriptions of these developing devices for the other colors will be omitted.

The housing 50 as a developer container contains a black (K) developer D composed of a carrier and a toner. A wall 57 partitions the housing 50 into a supply chamber 58 as an upper section and a mixing chamber 59 as a lower section. The supply chamber 58 accommodates the development roller 51 and the supply screw 52. The mixing chamber 59 accommodates the mixing screw 53.

The development roller 51 is disposed in an opening formed in the supply chamber 58 across from a cylindrical photoreceptor 11 as an image carrier. The development roller 51 includes a cylindrical development sleeve 511 and a magnet roller 512, which extends in the axial direction inside the development sleeve 511.

The magnet roller 512, for example, consists of radially arranged magnetic poles N1, S1, N2, S2 and N3 in sequence. The axial ends of the magnet roller 512 are fixed to the housing 50 to prevent the roller from turning. The magnetic poles extend along the axial direction.

The development sleeve 511 is partially exposed through the opening in the housing 50 across from the photoreceptor 11. The development sleeve 511 is attached to the housing 50 in such a manner that the development sleeve 511 is freely rotatable in the direction of arrow B. The development sleeve 511 rotates around the stationary magnet roller 512 while holding (carrying) the developer D on its surface by the magnetic force of the magnet roller 512.

The supply screw 52 is disposed inside the supply chamber 58 opposite to the photoreceptor 11 across the development roller 51 and to be parallel to the axial direction, and is supported on the housing 50 in a freely rotatable manner. The supply screw 52 rotates in the direction of arrow C to convey the developer D in the supply chamber 58 to the development roller 51 in the axial direction.

The mixing screw 53 is disposed inside the mixing chamber 59, extends parallel to the axial direction, and is supported on the housing 50 in a freely rotatable manner. The mixing screw 53 rotates in the direction of arrow J to convey the developer D in the mixing chamber 59 in a direction opposite to the conveying direction of the supply screw 52, while mixing the developer D.

The regulator 54 is disposed to form a gap between the edge of the regulator 54 and the surface of the development roller 51. The regulator 54 controls the amount of the developer D flowing through gap such that an appropriate amount of developer D is supplied to a development position F on the surface of the development roller 51.

Figure 4:
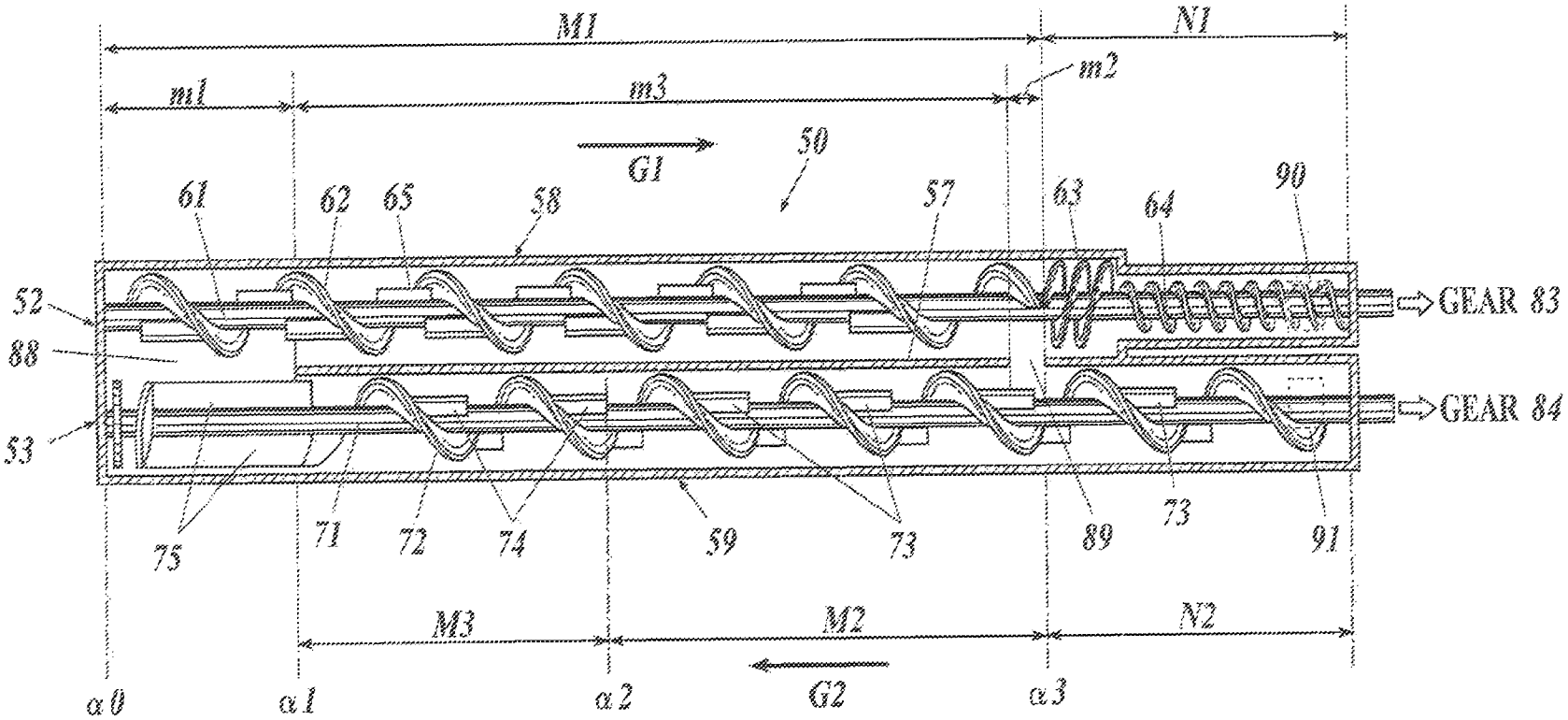
FIG. 4 is a cross-sectional view of the developing device of the present invention taken along line E-E in FIG. 3.

FIG. 4 is a cross-sectional view of the developing device 14 taken along line E-E in FIG. 3. FIG. 4 is a side view of an exemplary mechanism for transmitting rotational driving forces to the supply screw 52 and the mixing screw 53. FIG. 4 does not illustrate the developer D.

As illustrated in FIG. 4, the supply chamber 58 and the mixing chamber 59 in the housing 50 are cylinders that extend in the axial direction. These chambers are partitioned by the wall 57 but connect to each other through an opening 88 at one of the ends (the left end in the drawing) and an opening 89 at the other end (the right end in the drawing).

The supply chamber 58 and the mixing chamber 59 each have a region M1 including three regions along the axial direction, namely, a region m1 including the opening 88; a region m2 including the opening 89; and a region m3 disposed between the regions m1 and m2. The supply chamber 58 has a region N1 which is a region other than the region M1 along the axial direction, and the mixing chamber 59 has a region N2 which is a region other than the region M2 along the axial direction.

One axial end of the region M1 is referred to as a reference position $\alpha 0$; the other axial end is referred to as a position $\alpha 3$; the interface of the regions m1 and m3 is referred to as a position $\alpha 1$; and the middle position (midpoint) of the positions $\alpha 0$ and $\alpha 3$ is referred to as a position $\alpha 2$. The region M2 extends between the positions $\alpha 2$ and $\alpha 3$, and the region M3 extends between the positions $\alpha 1$ and $\alpha 2$.

The region M1 corresponds to a circulation path of developer D, as described later. The region N1 corresponds to a discharge path of the developer D for auto-refining development. The region N2 corresponds to a supply path of a replenishment developer D.

<Supply Screw 52>

The supply screw 52 includes a rotary shaft 61, spiral blades 62, 63, and 64, and a plurality of paddles 65. The axial ends of the rotary shaft 61 of the supply screw 52 are attached to the sidewalls of the supply chamber 58 with bearings (not shown) in such a manner that the rotary shaft 61 is freely rotatable. The right end in the drawing protrudes to the exterior of the sidewall. The protruding portion connects to a gear 83 (see FIG. 5) such that the rotational driving force from the gear 83 rotates the rotary shaft 61 in the direction of arrow C (see FIG. 3).

The spiral blades 62, 63, and 64 form spirals on the outer surface of the rotary shaft 61. The spiral blade 62 is disposed in the region M1, and the spiral blades 63 and 64 are disposed in the region N1.

The spiral blades 62 and 64 spiral in a direction that cause the developer D to flow through the supply chamber 58 in the direction of arrow G1 as the rotary shaft 61 rotates. On the other hand, the spiral blade 63 spirals in a direction that causes the developer D to flow in the direction opposite to arrow G1.

The spiral blade 63 spirals in a direction opposite to that of the spiral blade 62 and applies a conveying force against the developer D having been conveyed in the direction of arrow G1 by the spiral blade 62. The amount of the developer D that passes through the spiral blade 63 is determined by the difference between the conveying force of the spiral blade 62 and the conveying force of the spiral blade 63 in opposite directions. In this embodiment, only a slight amount of the developer D conveyed by the spiral blade 62 passes through the spiral blade 63 and reaches the spiral blade 64.

The spiral blade 64 in the region N1 conveys the slight amount of the developer D that has passed through the spiral blade 63 in the direction of arrow G1. The conveyed developer D is externally discharged from the developing device 14 through a developer outlet 90 (indicated by the dotted line) at the axial end of the supply chamber 58 in the region N1. The discharged developer D is collected in a container such as a collecting tank (not shown).

The paddles 65 are flat plates that project from the outer surface of the rotary shaft 61 in a direction orthogonal to the axial direction and are disposed along the axial direction to stand between the sections of the spiral blade 62. The paddles 65 rotate and push the developer D flowing in the axial direction around the axis (along the circumference). In this way, the paddles 65 restrict the movement of the developer D conveyed by the spiral blade 62.

The number and size of the paddles 65 are appropriately selected on the basis of the conveyance rate of the developer D in the mixing chamber 59.

<Mixing Screw 53>

The mixing screw 53 includes a rotary shaft 71, a spiral blade 72, and paddles 73, 74, and 75 having different sizes.

The axial ends of the rotary shaft 71 are attached to the sidewalls of the mixing chamber 59 with bearings (not shown) in such a manner that the rotary shaft 71 is freely rotatable. The right end in the drawing protrudes to the exterior of the sidewall. The protruding portion connects to a gear 84 (see FIG. 5) such that the rotational driving force from the gear 84 rotates the rotary shaft 71 in the direction of arrow J (see FIG. 3).

The spiral blade 72 forms a spiral on the outer surface of the rotary shaft 71 in the regions M3, M2, and N2 other than the region m1. The spiral blade 72 conveys the developer D in the mixing chamber 59 in the direction of arrow G2 (opposite to arrow G1) as the rotary shaft 71 rotates. The spiral blade 72 and the spiral blade 62 have the same pitch and the same outer diameter.

The paddle 75 scoops up the developer D having been conveyed to the region m1 by the spiral blade 72 on the rotating rotary shaft 71 in the mixing chamber 59. The rotation of the spiral blade 72 conveys the developer D through the opening 88 to the supply chamber 58. The paddle 75 may have any axial length relative to the opening 88. Preferably, the paddle 75 has an axial length equal to the axial length of the opening 88 to maximize the amount of the developer D to be conveyed through the opening 88.

<Drive Transmission Mechanism of Screws>

Figure 5:
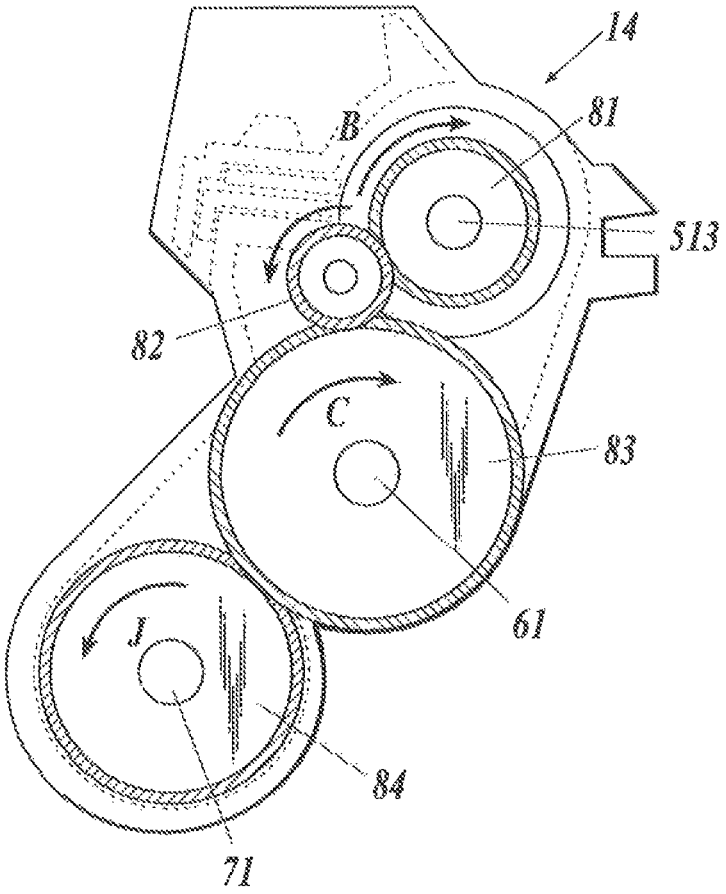
FIG. 5 is a diagram illustrating an exemplary mechanism for the transmission of a rotational driving force to a supply screw and a mixing screw in the developing device of the present invention.

A drive transmission mechanism that applies rotational driving forces to the supply screw 52 and the mixing screw 53 includes the gears 81 to 84, as illustrated in FIG. 5.

The gear 81 is attached to one end of a rotary shaft 513 of the development roller 51 (which corresponds to the rotational shaft of the development sleeve 511). The installment of the developing device 14 to an image forming apparatus causes the gear 81 to mesh with a gear (not shown) of the drive transmission mechanism of the image forming apparatus such that this gear transmits the driving force from a driving motor 45 to the gear 81. The driving force rotates the gear 81 in the direction of arrow B. The rotation of the gear 81 rotates the development sleeve 511 in the same direction.

The gear 83 is attached to the rotary shaft 61 of the supply screw 52 and meshes with the gear 81 through an idle gear 82. The gear 84 is attached to the rotary shaft 71 of the mixing screw 53 and meshes with the gear 83.

The rotational driving force of the driving motor 45 is transmitted from the gear 81 to the idle gear 82 and to the gears 83 and 84 in order. This rotates the gear 83 in the direction of arrow C and the gear 84 in the direction of arrow J. Consequently, the supply screw 52 rotates in the direction of arrow C, and the mixing screw 53 rotates in the direction of arrow J.

<Flow of Developer>

Figure 6:
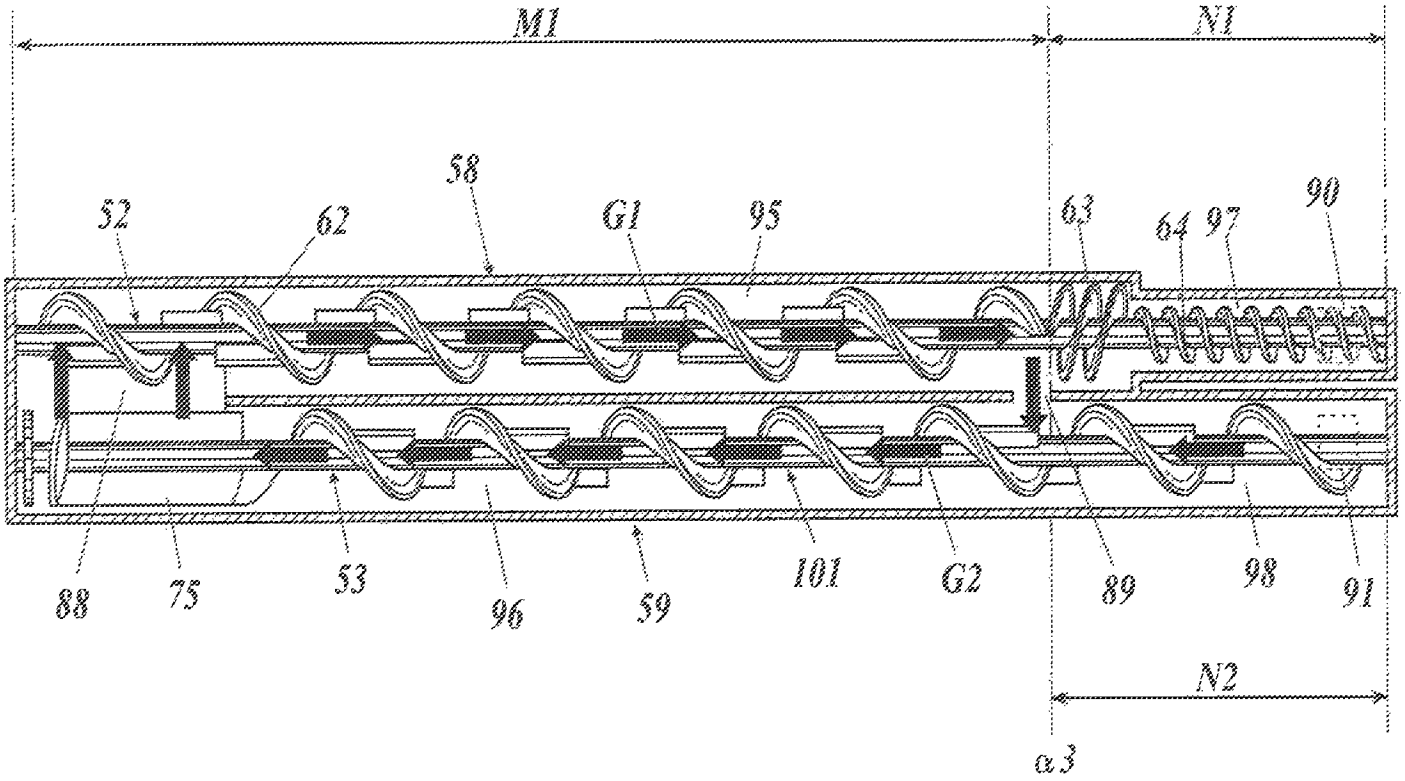
FIG. 6 is a schematic diagram illustrating the conveying directions of a developer in the developing device of the present invention.

The rotation of the development roller 51, the supply screw 52, and the mixing screw 53 conveys the developer D in the housing 50, as illustrated in FIG. 6.

FIG. 6 is a schematic diagram including arrows indicating the conveying directions of the developer D. As illustrated in FIG. 6, the developer D in the supply chamber 58 is conveyed to the right in the drawing (in the direction of arrow G1) by the spiral blade 62 of the supply screw 52 in the region M1. The stream of the developer D branches at the downstream end of the developer D in the region M1 into a flow that enters the mixing chamber 59 through the opening 89 and a flow that enters the region N1.

The spiral blade 63 having a reverse turn to the spiral blade 62 is disposed near the internal edge of the region N1. Thus, most of the developer D entering the region N1 cannot pass through the spiral blade 63 and is pushed back to the upstream of the conveying direction, entering the mixing chamber 59 through the opening 89. Thus, only a slight fraction of the developer D can pass through the spiral blade 63 to reach the spiral blade 64. The developer D that passes through the spiral blade 63 and reaches the spiral blade 64 is conveyed through the region N1 (a discharge path 97 of the developer D) by the spiral blade 64 and is externally discharged through the developer outlet 90.

The developer D having been conveyed to the mixing chamber 59 through the opening 89 is conveyed to the left in the drawing (in the direction of arrow G2) in the region M1 by the mixing screw 53. The developer D is then scooped up by the paddle 75 at the downstream stream end near the opening 88 and is pushed through the opening 88 into the supply chamber 58. The developer D having been conveyed to the supply chamber 58 is then to the right in the drawing (in the direction of arrow G1) by the supply screw 52.

The downstream area in the conveying direction in the supply chamber 58 and the upstream area in the conveying direction in the mixing chamber 59 are connected through the opening 39 in region M1, while the downstream area in the conveying direction in the mixing chamber 59 and the upstream area in the conveying direction in the supply chamber 58 are connected through the opening 83. As a result, the region M1 first conveying path 95) through which the developer D is conveyed by the supply screw 52 in the supply chamber 58 and the region M1 (second conveying path 96) through which the developer D is conveyed by the mixing screw 53 in the mixing chamber 59 are connected through the openings 88 and 89 (first and second connection paths). This forms a circulation path 101 of the developer D inside the supply chamber 58 and the mixing chamber 59. The developer D circulates through the circulation path 101.

The developer D having been conveyed through the region M1 in the supply chamber 58 of the circulation path 101 is partially supplied to the development roller 51. Specifically, the developer D conveyed through the region M1 in the supply chamber 58 is attached to the surface of the development sleeve 511 by the magnetic force of the magnetic pole N1 (catch pole) of the magnet roller 512, which is illustrated in FIG. 3. The developer D attached to the surface of the development sleeve 511 passes through the gap between the regulator 54 and the development sleeve 511 as the development sleeve 511 rotates. The amount of the developer D to pass through the nip is controlled by the regulator 54. As a result, a predetermined amount of developer D is conveyed across the magnetic pole 51 and reaches the development position F opposing the photoreceptor 11.

The developer D having been conveyed to the development position F forms a magnetic brush by the force of the magnetic pole N2 and is used for the development of an electrostatic latent image on the photoreceptor 11. After used for the development, the developer D is conveyed across the development position F and the magnetic pole S2. The developer D is released from the magnetic force of the magnet roller 512 when it is conveyed through the magnetic pole N3 and is collected by the supply screw 52 to be returned to the circulation path 101 by the supply screw 52.

<Supply Unit for Supplying Developer>

As illustrated in FIG. 6, the region N2 in the upstream of the region M1 in the developer conveying direction in the mixing chamber 59 has a replenishment supply path 98 for a fresh (replenishment) developer D.

In addition to the developing device 14, an embodiment of the present invention involves hoppers (not shown) each used for separately storing a carrier of the replenishment developer or a toner of the replenishment developer and a density sensor (not shown) for detecting the density of the developer D in the housing 50. The carrier and the toner of the replenishment developer are independently supplied from the hoppers through a replenishment developer inlet 91 (indicated by the dotted line) to the supply path 98 in the mixing chamber 59.

Specifically, a predetermined amount of the carrier is supplied every predetermined time (for example, several seconds) during the rotation of the development roller 51, the supply screw 52 and the mixing screw 53. The amount of the developer. D in the housing 50 increases as a result of the supply of the carrier. The developer D is, however, discharged from the developer outlet 90 in an amount equivalent to the amount of the supplied carrier. Thus, the amount of the developer D repeatedly fluctuates within a predetermined range without a continuous increase in the housing 50.

For the supplementation of the toner, the ratio of the toner to the carrier is detected by the density sensor during the rotation of the development roller 51 and other components for image formation. If the amount of the toner is determined to be small on the basis of the detected ratio, the toner in an amount required for the increase of a predetermined toner ratio is supplied from the hopper to the housing 50.

The above supplementations are controlled by a control unit (not shown) of the developing device. Any other method for such a control may be employed for carrying out auto-refining development.

In another embodiment, a mixture of a toner and a carrier in a predetermined ratio is supplied from the hopper as the replenishment developer. In such a case, the ratio of the toner to the carrier is detected by a density sensor during the rotation of the development roller 51 and other components for image formation. If the amount of the toner is determined to be small on the basis of the detected ratio, a predetermined amount of the developer is supplied.

The developer (carrier and toner) supplied through the replenishment developer inlet 91 to the supply path 98 in the mixing chamber 59 merges with the developer D having been conveyed from the supply chamber 58 through the opening 89 at the upstream end (position α3) of the region M2 in the upstream of the second conveying path 96 of the mixing chamber 59 in the conveying direction.

The developer D is charged by contact of the carrier particles with the toner particles contained in the developer D while the developer D is being mixed (agitated) and conveyed through the second conveying path 96 in the mixing chamber 59 by the mixing screw 53. The charged developer D is conveyed to the supply chamber 58.

The embodiments of the present invention described above provides a developing device that supplies a toner and a carrier separately and discharges the degraded developer, and a developing device that supplies a mixture of a toner and a carrier (i.e., a developer) and discharges the degraded developer. The developing device of the present invention may supply a toner and a carrier separately. The supplementation of a mixture of a toner and a carrier (i.e., developer) is more advantageous in that the configuration of the device can be simplified.

The ratio of the poured bulk density of the replenishment developer supplied to the developing device of the present invention to the poured bulk density of the developer contained in the developer container is within the range of 0.60 to 0.95. In proportion to the number of printouts, the toner and the carrier for replenishment, i.e., the replenishment developer is supplied through the replenishment developer inlet while the degraded developer is discharged from the developer outlet.

<<Electrophotographic Image Forming Apparatus>>

<Configuration of Electrophotographic Image Forming Apparatus>

Figure 7:
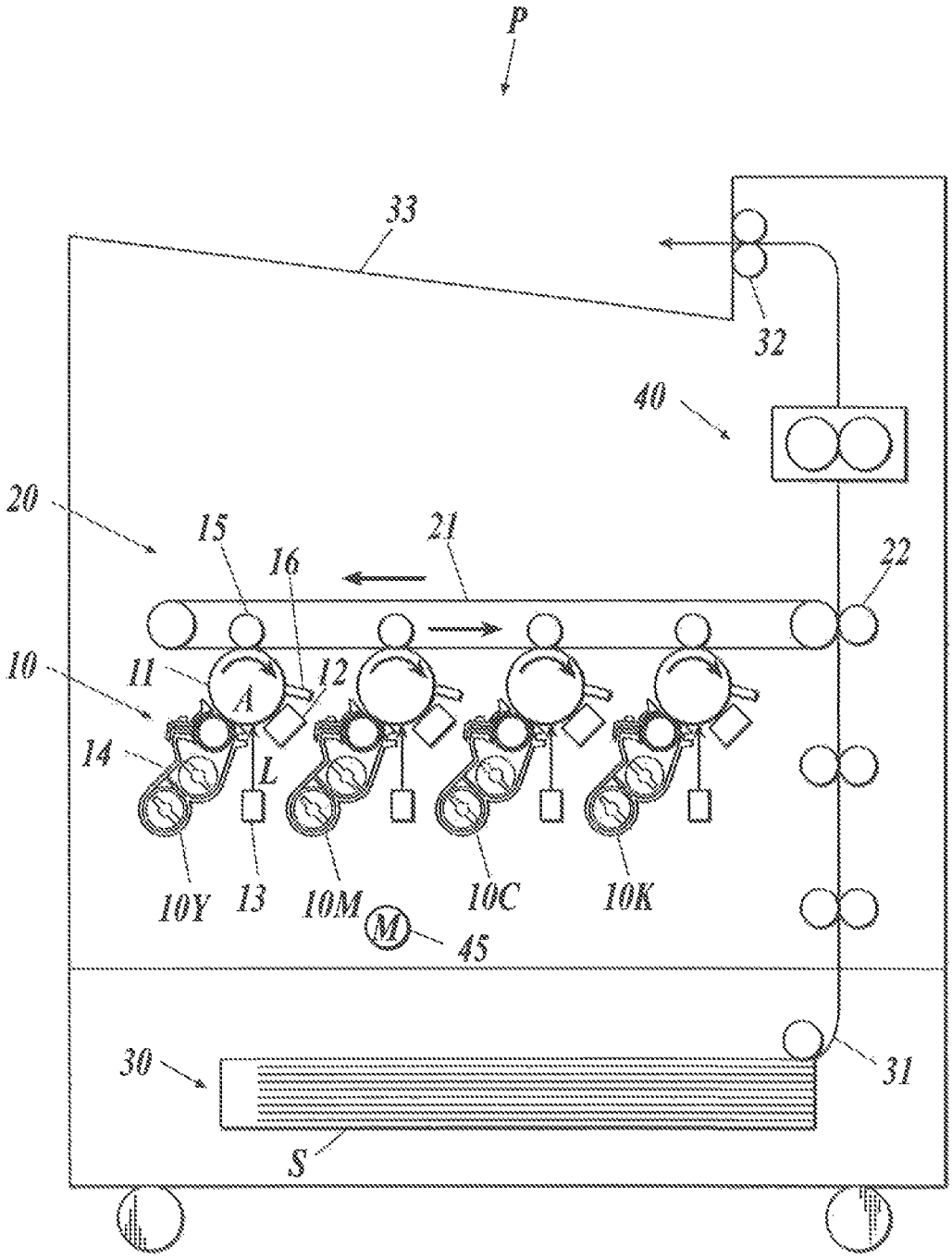
FIG. 7 is a schematic view of a printer that is an image forming apparatus of an embodiment of the present invention.

FIG. 7 is a schematic view of a printer P that is an embodiment of the whole configuration of the electrophotographic image forming apparatus of the present invention.

The printer P illustrated in FIG. 7 forms images through a known electrophotographic process, and includes an image processing unit 10, an intermediate transfer unit 20 including an intermediate transfer belt 21, a feeder 30 and a fixing unit 40. The printer P performs color printing in response to a job request from an external terminal (not shown) connected via a network (for example, local area network (LAN)).

The image processing unit 10 includes image forming units 10Y, 10M, 10C, and 10K for the color reproduction of yellow (Y), magenta (M), cyan (C), and black (K), respectively. The image processing unit 10Y includes a photoreceptor 11 and other components disposed around the photoreceptor 11, such as a charger 12, an exposure unit 13, the developing device 14, a primary transfer roller 15, and a cleaner 16.

The charger 12 charges the surface of the photoreceptor 11, which rotates in the direction of arrow A. The exposure unit 13 exposes and scans the charged photoreceptor 11 with a laser beam L to form an electrostatic latent image on the photoreceptor 11.

The developing device 14 for auto-refining development contains a two-component developer composed of a carrier and a toner and develops an electrostatic latent image on the photoreceptor 11 using the toner. As a result, a yellow toner image is formed on the photoreceptor 11.

The primary transfer roller 15 transfers the yellow toner image on the photoreceptor 11 onto the intermediate transfer belt 21 through electrostatic interaction. The cleaner 16 cleans off the remaining toner on the photoreceptor 11 after the transfer. The other image processing units 10M, 10C, and 10K have the same configuration as that of the image processing unit 10Y, and the reference characters of their components are not shown in the drawing.

The intermediate transfer belt 21 is stretched between a driving roller and a driven roller and continuously runs in the direction indicated by arrows in the drawing by the driving force of the driving roller.

The image processing units 10Y, 10M, 10C, and 10K form toner images of the corresponding colors on the respective photoreceptors 11. These toner images are each transferred onto the intermediate transfer belt 21. In image forming, the yellow, magenta, cyan, and black toner images are transferred onto the same position of the running intermediate transfer belt 21 at different timings from the upstream side to the downstream side.

The feeder 30 feeds transfer sheets S from a feeder cassette, each sheet being fed at a time in synchronization with the above image formation. The fed transfer sheets S are sent to a secondary transfer roller 22 through a conveying path 31.

The toner images of the four colors on the intermediate transfer belt 21 are simultaneously transferred onto a transfer sheet S by electrostatic interaction of the secondary transfer roller 22 while the transfer sheet S passes through the nip between the secondary transfer roller 22 and the intermediate transfer belt 21.

The transfer sheet S after the secondary transfer of the toner images of respective colors is conveyed to the fixing unit 40. At the fixing unit 40, the transfer sheet S is heated and pressed to thermally melt and fix the toners to the surface of the transfer sheet S. The transfer sheet S is then output to an output tray 33 by an output roller 32.

The driving motor 45 disposed below the image processing unit 10M is a driving source of the rotors in the printer P such as the photoreceptor 11, the intermediate transfer belt 21 and the primary transfer roller 15. The rotors are rotated by receiving a driving force from the driving motor 45 via a drive transmission mechanism (not shown).

Example

The present invention will now be described in detail with reference to Examples below. The present invention, however, is not limited to these examples.

<Preparation of Carrier Core Particles>

(Preparation of Carrier Core Particle 1)

Raw materials were weighed to obtain 35 mol % MnO, 14.5 mol % MgO, 50 mol % $Fe_2O_3$ and 0.5 mol % SrO. The weighed raw materials were mixed with water and pulverized in a wet medium mill for five hours to obtain a slurry.

The obtained slurry was dried with a spray drier to obtain spherical particles. MnO was prepared from manganese carbonate, and MgO was prepared from magnesium hydroxide so as to adjust the poured bulk density. After the adjustment of the size of the particles, the particles were calcined for two hours at 950° C. A small poured bulk density and an appropriate fluidity were achieved by pulverization of the calcined particles in a wet ball mill for one hour with stainless steel beads having a diameter of 0.3 cm, followed by pulverization for four hours with zirconia beads having a diameter of 0.5 cm. An appropriate amount of dispersant was added to the resulting slurry, and 0.8 mass % PVA with respect to the solid component of the slurry was added as a binder to obtain particles with sufficient strength and an appropriate poured bulk density. The slurry was then granulated and dried with a spray drier. The dried grains were sintered in an electric furnace for 3.5 hours at 1150° C. at an oxygen concentration of 0 volume %.

The sintered grains were disintegrated and classified to adjust the grain size. The classified grains were magnetically separated to remove the grains with a low-magnetic force. Porous carrier core particles 1 were thus obtained. The diameter of the fine pores in the carrier core particles 1 was 0.43 μm.

(Preparation of Carrier Core Particle 2)

Porous carrier core particles 2 were prepared by the same way as the carrier core particles 1 were prepared except that manganese dioxide was used instead of the manganese carbonate used in the preparation of the carrier core particles 1, raw materials were weighed to obtain 30 mol % MnO, 19.5 mol % MgO, 50 mol % $Fe_2O_3$ and 0.5 mol % SrO, the binder added was 0.5 mass %, and the sintering was performed in an electric furnace for six hours at 1.250° C. at an oxygen concentration of 1.5 volume %. The diameter of the fine pores in the carrier core particles 2 was 0.65 μm.

(Preparation of Carrier Core Particle 3)

Porous carrier core particles 3 were prepared by the same way as the carrier core particles 1 were prepared except that manganese dioxide was used instead of manganese carbonate used in the preparation of the carrier core particles 1, the binder added was 0.5 mass %, and the sintering was performed in an electric furnace for six hours at 1200° C. at an oxygen concentration of 1.5 volume %. The diameter of the fine pores in the carrier core particles 3 was 0.53 μm.

(Preparation of Carrier Core Particle 4)

Porous carrier core particles 4 were prepared by the same way as the carrier core particles 1 were prepared except that trimanganese tetroxide was used instead of manganese carbonate used in the preparation of the carrier core particles 1, the raw materials were weighed to obtain 40 mol % MnO, 9.5 mmol % MgO, 50 mol % $Fe_2O_3$ and 0.5 mol % SrO, and the sintering was performed in an electric furnace for four hours at 1125° C. at an oxygen concentration of 0.5 volume %. The diameter of the fine pores in the carrier core particles 4 was 0.25 μm.

(Preparation of Carrier Core Particle 5)

Porous carrier core particles 5 were prepared by the same way as the carrier core particles 1 were prepared except that trimanganese tetroxide was used instead of manganese carbonate used in the preparation of the carrier core particles 1 and the sintering was performed in an electric furnace for four hours at 1125° C. at an oxygen concentration of 0.5 volume %. The diameter of the fine pores in the carrier core particles 5 was 0.27 μm.

(Preparation of Carrier Core Particle 6)

Porous carrier core particles 6 were prepared by the same way as the carrier core particles 1 were prepared except that stainless steel beads having a diameter of 0.15 mm were used instead of the zirconia beads having a diameter of 0.5 cm, the binder added was 1.0 mass %, and the sintering was performed in an electric furnace at 1100° C. The diameter of the fine pores in the carrier core particles 6 was 0.18 μm.

(Preparation of Carrier Core Particle 7)

Porous carrier core particles 7 were prepared by the same way as the carrier core particles 1 were prepared except that the calcination temperature was changed to 1100° C. from 950° C., which was the calcination temperature in the preparation of the carrier core particles 1 and the calcined particles were pulverized for 12 hours and then sintered at 1300° C. for two hours in an atmosphere with an oxygen concentration of 2.5 volume %. The diameter of the fine pores in the carrier core particles 7 was 0.80 μm.

(Preparation of Carrier Core Particle 8 (Non-porous Carrier Core Particle))

Non-porous carrier core particles 8 were prepared by toe same way as the carrier core particles 1 were prepared except that the raw materials were weighed to obtain 25 mol % MnO, 24.5 mol % MgO, 50 mol % $Fe_2O_3$ and 0.5 mol % SrO, the weighed raw materials were mixed with water and pulverized in a wet medium mill for five hours to obtain slurry, the sintering was performed in an electric furnace maintained at 1350° C. for six hours.

<Preparation of Carrier>

(Preparation of Carrier 1)

Carrier raw materials were weighed to obtain 100 parts of the carrier core particles 1; 0.4 part of ferrite particles (0.3 μm) prepared by fine pulverization of the core particles; and 5.0 parts of resin fine particles for a coating consisting of copolymers of cyclohezyl methacrylate and methyl methacrylate (copolymerization ratio of 1:1), the resin fine particles having a weight-average molecular weight of 400,000, a glass-transition temperature of 115° C., and a grain size ($D_{50}$) of 100 nm. The raw materials were fed into a high-speed agitation mixer with mixing blades and slowly mixed at a peripheral speed of 1 m/s for two minutes in the process of preliminary mixing. In the subsequent process of the formation of carrier intermediates, cold water was circulated through the jacket, and the raw materials were mixed at a peripheral speed of 8 m/s for 20 minutes at 40° C. to form the carrier intermediates. In the process of the formation of carrier particles, steam was circulated through the jacket, and the carrier intermediates were mixed (agitated) at a peripheral speed of 8 m/s for 30 minutes at 120° C. A carrier 1 consisting of carrier particles was thus obtained. The volume-based median diameter was 35 μm, the poured bulk density was 1.72 g/cm$^3$, and the thickness of the resin coating layer was 1.0 μm. The thickness of the resin coating layer was measured by the process described above.

(Preparation of Carriers 2 to 8)

Carriers 2 to 8 were obtained by the same way as the carrier 1 was prepared except that the carrier core particles were changed as shown in Table 1 and the thickness of the resin coating layer was 1 μm.

TABLE 1

| CARRIER No. | CARRIER CORE PARTICLE No. | CARRIER CORE PARTICLE COMPOSITION | CARRIER CORE PARTICLE DIAMETER [μm] | POURED BULK DENSITY [g/cm$^3$] | FINE PORE DIAMETER [μm] | COATING RESIN AMOUNT (PARTS BY MASS) | AVERAGE THICKNESS [μm] | MAGNETIZATION $\sigma^{1000}$ [A · m$^2$/kg] | MAGNETIZATION $\sigma^{1000*}$ [10$^3$ A/m] | REMANENCE MAGNETIZATION [A · m$^2$/kg] |
|---|---|---|---|---|---|---|---|---|---|---|
| CARRIER 1 | CORE PARTICLE 1 | POROUS FERRITE PARTICLE | 35 | 1.72 | 0.43 | 5.0 | 1.0 | 58 | 99.8 | 2.2 |
| CARRIER 2 | CORE PARTICLE 2 | POROUS FERRITE PARTICLE | 35 | 2.04 | 0.65 | 4.2 | 1.0 | 54 | 110.2 | 0.8 |

TABLE 1-continued

| CARRIER No. | CARRIER CORE PARTICLE No. | CARRIER CORE PARTICLE COMPOSITION | CARRIER CORE PARTICLE DIAMETER [μm] | POURED BULK DENSITY [g/cm³] | FINE PORE DIAMETER [μm] | COATING RESIN AMOUNT (PARTS BY MASS) | AVERAGE THICKNESS [μm] | MAGNETIZATION $\sigma^{1000}$ [A · m²/kg] | MAGNETIZATION $\sigma^{1000}$* [10³ A/m] | REMANENCE MAGNETIZATION [A · m²/kg] |
|---|---|---|---|---|---|---|---|---|---|---|
| CARRIER 3 | CORE PARTICLE 3 | POROUS FERRITE PARTICLE | 35 | 1.94 | 0.53 | 4.4 | 1.0 | 57 | 110.6 | 1.0 |
| CARRIER 4 | CORE PARTICLE 4 | POROUS FERRITE PARTICLE | 35 | 1.29 | 0.25 | 6.7 | 1.0 | 63 | 81.3 | 4.5 |
| CARRIER 5 | CORE PARTICLE 5 | POROUS FERRITE PARTICLE | 35 | 1.29 | 0.27 | 6.7 | 1.0 | 58 | 74.8 | 4.3 |
| CARRIER 6 | CORE PARTICLE 6 | POROUS FERRTTE PARTICLE | 35 | 1.03 | 0.18 | 8.3 | 1.0 | 57 | 58.7 | 4.9 |
| CARRIER 7 | CORE PARTICLE 7 | POROUS FERRITE PARTICLE | 35 | 2.10 | 0.80 | 4.1 | 1.0 | 60 | 126.0 | 1.5 |
| CARRIER 8 | CORE PARTICLE 8 | NON-POROUS FERRITE PARTICLE | 35 | 2.15 | 0.00 | 3.6 | 1.0 | 45 | 96.8 | 0.9 |

*MAGNETIZATION PER BULK VOLUME

<Provision of Toner>

A black toner for a digital multifunctional peripheral machine Bizhub C360 (manufactured by Konica Minolta Business Technologies, Inc.) was provided. The average roundness of this toner was 0.945.

<Preparation of Initial Developer 1*a*>

The carrier 1 prepared above and the black toner were placed in the ratio of 92.0 parts by mass to 8.0 parts by mass in a V blender and mixed for 20 minutes at a rotational rate of 20 rpm under normal temperature and humidity (temperature of 20° C. and relative humidity of 50% RH). The mixed materials were then sifted through a 1.25 μm mesh to obtain an initial developer 1*a*.

<Preparation of Initial Developer 8*a*>

An initial developer 8*a* was prepared by the same way as the initial developer 1*a* was prepared except that the carrier 8 prepared above and the black toner were placed in the ratio of 93.5 parts by a mass to 6.5 parts by mass in a V blender.

<Preparation of Replenishment Developer>

The carriers 1 to 8 prepared as described above and the black toner were mixed in the ratios shown in Table 2 in a shaker Model-YGG (manufactured by Yayoi Co., Ltd.) for five minutes to prepare replenishment developers 1 to 8. The replenishment developers 1 to 8 were prepared by providing the same bulk volume of the carriers, and then mixing ratios of the carriers to the toner were determined.

TABLE 2

| REPLENISHMENT DEVELOPER No. | CARRIER No. | CARRIER (PARTS BY MASS) | TONER (PARTS BY MASS) |
|---|---|---|---|
| DEVELOPER 1 | CARRIER 1 | 8.0 | 92.0 |
| DEVELOPER 2 | CARRIER 2 | 9.5 | 90.5 |
| DEVELOPER 3 | CARRIER 3 | 9.0 | 91.0 |
| DEVELOPER 4 | CARRIER 4 | 6.0 | 94.0 |
| DEVELOPER 5 | CARRIER 5 | 6.0 | 94.0 |
| DEVELOPER 6 | CARRIER 6 | 4.8 | 95.2 |
| DEVELOPER 7 | CARRIER 7 | 9.8 | 90.2 |
| DEVELOPER 8 | CARRIER 8 | 10.0 | 90.0 |

<<Evaluation>>

The developers prepared above were installed in sequence in the image evaluator described below in the combinations shown in Table 3. Printing was performed and printouts were evaluated. The developer contained in advance in each developer container was the initial developer 1*a* or 8*a* containing the carrier 1 or 8. After using the initial developer 1*a* or 8*a*, either of the replenishment developers 1 to 8 were supplied as shown in Table 3.

TABLE 3

| | INITIAL DEVELOPER | | | | | |
|---|---|---|---|---|---|---|
| | DEVELOPER No. | CARRIER No. | CARRIER (PARTS BY MASS) | POURED BULK DENSITY ($d_1$) [g/cm³] | TONER (PARTS BY MASS) | REPLENISHMENT DEVELOPER DEVELOPER No. |
| EXAMPLE 1 | DEVELOPER 8a | CARRIER 8 | 93.5 | 2.15 | 6.5 | DEVELOPER 1 |
| EXAMPLE 2 | DEVELOPER 8a | CARRIER 8 | 93.5 | 2.15 | 6.5 | DEVELOPER 2 |
| EXAMPLE 3 | DEVELOPER 8a | CARRIER 8 | 93.5 | 2.15 | 6.5 | DEVELOPER 3 |
| EXAMPLE 4 | DEVELOPER 8a | CARRIER 8 | 93.5 | 2.15 | 6.5 | DEVELOPER 4 |
| EXAMPLE 5 | DEVELOPER 8a | CARRIER 8 | 93.5 | 2.15 | 6.5 | DEVELOPER 5 |

TABLE 3-continued

| | | | | | | |
|---|---|---|---|---|---|---|
| COMPARATIVE EXAMPLE 1 | DEVELOPER 8a | CARRIER 8 | 93.5 | 2.15 | 6.5 | DEVELOPER 6 |
| COMPARATIVE EXAMPLE 2 | DEVELOPER 8a | CARRIER 8 | 93.5 | 2.15 | 6.5 | DEVELOPER 7 |
| COMPARATIVE EXAMPLE 3 | DEVELOPED 8a | CARRIER 8 | 93.5 | 2.15 | 6.5 | DEVELOPER 8 |
| COMPARATIVE EXAMPLE 4 | DEVELOPER 1a | CARRIER 1 | 92.0 | 1.72 | 8.0 | DEVELOPER 1 |

| | REPLENISHMENT DEVELOPER | | | MAGNETIZATION | |
|---|---|---|---|---|---|
| | CARRIER No. | POURED BULK DENSITY ($d_2$) [g/cm$^3$] | POURED BULK DENSITY RATIO ($d_2/d_1$) | RATIO PER BULK VOLUME (REPLENISHMENT DEVELOPER/ INITIAL DEVELOPER) | BULK DENSITY DIFFERENCE ($d_1 - d_2$) |
| EXAMPLE 1 | CARRIER 1 | 1.72 | 0.80 | 1.03 | 0.43 |
| EXAMPLE 2 | CARRIER 2 | 2.04 | 0.95 | 1.14 | 0.11 |
| EXAMPLE 3 | CARRIER 3 | 1.94 | 0 90 | 1.14 | 0.21 |
| EXAMPLE 4 | CARRIER 4 | 1.29 | 0.60 | 0.84 | 0.86 |
| EXAMPLE 5 | CARRIER 5 | 1.29 | 0.60 | 0.77 | 0.86 |
| COMPARATIVE EXAMPLE 1 | CARRIER 6 | 1.03 | 0.48 | 0.61 | 1.12 |
| COMPARATIVE EXAMPLE 2 | CARRIER 7 | 2.10 | 0.98 | 1.30 | 0.05 |
| COMPARATIVE EXAMPLE 3 | CARRIER 8 | 2.15 | 1.00 | 1.00 | 0.00 |
| COMPARATIVE EXAMPLE 4 | CARRIER 1 | 1.72 | 1.00 | 1.00 | 0.00 |

The image evaluator was a digital multifunctional peripheral Bizhub C360 (manufactured by Konica Minolta Business Technologies, Inc.) including auto-refining developing devices. The developing device for black was used for evaluation.

(Fogging)

The fogging density on a blank sheet initially printed (i.e., the initial or first-time printing) and the fogging density on a blank sheet printed after printing a character image with a coverage rate of 5% on 200,000 sheets of A4 at normal temperature and humidity (20° C. and 50% RH) were evaluated on the basis of the density of an unprinted transfer material. The density of the unprinted transfer material was defined as the average of the densities at 20 points on the sheet of A4. The densities were measured with a reflection densitometer RD-918 (manufactured by Macbeth Corp.) Fogging of 0.01 or less was acceptable.

(Transfer Rate)

A solid image (20 mm×50 mm) with an image density of 1.30 initially printed (i.e., the initial or first-time printing) and a solid image (20 mm×50 mm) with an image density of 1.30 printed after printing a character image with a coverage rate of 5% on 200,000 sheets of A4 at normal temperature and humidity (20° C. and 50% RH) were evaluated for their transfer rates.

The transfer rates were determined by the following equation.

transfer rate(%)=(mass of toner transferred to transfer material/mass of toner developed on photoreceptor)×100

A transfer rate of 85% or more was acceptable.

(Carrier Adhesion)

A solid image of A4 initially printed (i.e., the initial or first-time printing) and a solid image printed after printing a character image with a coverage rate of 5% on 200,000 sheets of A4 at normal temperature and humidity (20° C. and 50% RH) were evaluated for carrier adhesion. The carrier adhesion was evaluated by visually counting the number of the carrier particles attached to the solid images through a microscope. Five or less counts of the carrier particles were acceptable.

The results of the evaluations are shown in Table 4.

TABLE 4

| | INITIAL | REPLENISHMENT | EVALUATION RESULT | | | | | |
|---|---|---|---|---|---|---|---|---|
| | | | INITIAL PRINTING | | | AFTER PRINTING | | |
| | DEVELOPER DEVELOPER No. | DEVELOPER DEVELOPER No. | FOGGING | TRANSFER RATIO [%] | CARRIER ADHESION | FOGGING | TRANSFER RATIO [%] | CARRIER ADHESION |
| EXAMPLE 1 | DEVELOPER 8a | DEVELOPER 1 | 0.002 | 95 | 0 | 0.002 | 96 | 0 |
| EXAMPLE 2 | DEVELOPER 8a | DEVELOPER 2 | 0.002 | 95 | 0 | 0.003 | 90 | 0 |
| EXAMPLE 3 | DEVELOPER 8a | DEVELOPER 3 | 0.002 | 95 | 0 | 0.003 | 95 | 0 |
| EXAMPLE 4 | DEVELOPER 8a | DEVELOPER 4 | 0.002 | 95 | 0 | 0.001 | 97 | 3 |
| EXAMPLE 5 | DEVELOPER 8a | DEVELOPER 5 | 0.002 | 95 | 0 | 0.005 | 97 | 3 |
| COMPARATIVE EXAMPLE 1 | DEVELOPER 8a | DEVELOPER 6 | 0.002 | 95 | 0 | 0.000 | 98 | 8 |
| COMPARATIVE EXAMPLE 2 | DEVELOPER 8a | DEVELOPER 7 | 0.002 | 95 | 0 | 0.011 | 89 | 0 |

TABLE 4-continued

| | INITIAL | REPLENISHMENT | EVALUATION RESULT | | | | | |
|---|---|---|---|---|---|---|---|---|
| | | | INITIAL PRINTING | | | AFTER PRINTING | | |
| | DEVELOPER DEVELOPER No. | DEVELOPER DEVELOPER No. | FOGGING | TRANSFER RATIO [%] | CARRIER ADHESION | FOGGING | TRANSFER RATIO [%] | CARRIER ADHESION |
| COMPARATIVE EXAMPLE 3 | DEVELOPER 8a | DEVELOPER 8 | 0.002 | 95 | 0 | 0.012 | 84 | 0 |
| COMPARATIVE EXAMPLE 4 | DEVELOPER 1a | DEVELOPER 1 | 0.011 | 97 | 0 | 0.002 | 98 | 0 |

The results in Table 4 show that the auto-refining developing devices using the developers of the present invention are excellent in the level of fogging, the transfer rate and the level of the carrier adhesion at the initial printing (the initial or first-time printing) and after printing 200,000 sheets. In contrast, the comparative examples 1 to 4 are inferior in the level of fogging, the transfer rate and/or the level of the carrier adhesion at the initial printing (the initial or first-time printing) and after printing 200,000 sheets. The comparative example 4 using porous carriers with a small poured bulk density for both of the initial developer and the replenishment developer shows a delayed rising edge of the charge and causes fogging at the initial printing.

The entire disclosure of Japanese Patent Application No. 2013-006863 filed on Jan. 18, 2013 including description, claims, drawings and abstract is incorporated herein by reference in its entirely.

Although various exemplary embodiments have been shown and described, the present invention is not limited to the embodiments shown. Therefore, the scope of the present invention is intended to be limited solely by the scope of the claims that follow.

What is claimed is:

1. A developing device comprising:

a developer container which contains a developer composed of a toner and a first carrier;

a developing unit which develops an electrostatic latent image on an image carrier using the developer contained in the developer container;

a developer outlet which discharges the developer contained in the developer container; and a replenishment developer inlet which supplies a replenishment developer to the developer container, wherein the replenishment developer comprises a second carrier, and a ratio of a poured bulk density of the second carrier to a poured bulk density of the first carrier ranges from 0.60 to 0.95.

2. The developing device of claim 1, wherein a difference between the poured bulk density of the second carrier and the poured bulk density of the first carrier is greater than 0.2 g/cm$^3$.

3. The developing device of claim 1, wherein the first carrier and the second carrier comprise resin-coated carrier particles composed of carrier core particles covered with resin.

4. The developing device of claim 1, wherein a ratio of a magnetization at 1000 Oe per bulk volume of the second carrier to a magnetization at 1000 Oe per bulk volume of the first carrier ranges from 0.84 to 1.15.

5. The developing device of claim 1, wherein a remanence magnetization of the second carrier ranges from 0.1 to 5.0 A·m$^2$/kg.

6. The developing device of claim 1, wherein an average roundness of toner particles constituting the toner ranges from 0.900 to 0.970.

7. The developing device of claim 1, wherein carrier core particles constituting at least the second carrier are porous ferrite particles of a ferrite represented by a following formula:

$$(MO)_x(Fe_2O_3)_y,$$

wherein M represents a metal atom selected from the group consisting of manganese, magnesium, strontium, calcium, titanium, copper, zinc, nickel and silicon or a combination thereof, x represents a molar ratio of 5 to 70 mol %, and y represents a molar ratio of 30 to 95 mol %.

8. The developing device of claim 1, wherein carrier core particles constituting at least the second carrier are porous ferrite particles having pores with diameters ranging from 0.2 to 0.7 μm.

9. An image forming apparatus comprising the developing device of claim 1.

* * * * *